United States Patent [19]

Ishii

[11] 4,368,458

[45] Jan. 11, 1983

[54] MOTOR ACTUATED BELL

[75] Inventor: Tadashi Ishii, Tokyo, Japan

[73] Assignee: Kobishi Electric Co., Ltd., Tokyo, Japan

[21] Appl. No.: 175,775

[22] Filed: Aug. 6, 1980

[51] Int. Cl.[3] ..... G08B 3/00

[52] U.S. Cl. ..... 340/396; 340/392; 340/399; 340/402

[58] Field of Search ..... 340/392, 396, 399, 402, 340/403, 400, 390, 391, 393; 116/152, 153, 154, 155, 156, 157, 158, 159, 160; 161, 162, 163, 164

[56] References Cited

U.S. PATENT DOCUMENTS

| | | | |
|---|---|---|---|
| 385,574 | 7/1888 | Sanderson | 116/157 |
| 386,164 | 7/1888 | Sanderson | 116/157 |
| 461,241 | 10/1891 | Grantland | 116/157 |
| 1,694,247 | 12/1928 | Briggs | 340/390 X |
| 1,716,369 | 6/1929 | Critchfield | 340/390 |
| 1,809,331 | 6/1931 | Duncan | 340/393 |
| 3,076,960 | 2/1963 | Knutson | 340/402 X |
| 4,183,018 | 1/1980 | Sakaguchi | 340/396 |
| 4,286,258 | 8/1981 | Ishii | 340/402 X |

OTHER PUBLICATIONS

Helios 39, Jahrg. 1933, No. 21, Fachteil, Mar. 21, 1933, p. 168.

*Primary Examiner*—Marshall M. Curtis
*Assistant Examiner*—Daniel Myer
*Attorney, Agent, or Firm*—Darby & Darby

[57] ABSTRACT

In a motor actuated bell a cam member is operatively connected to a motor drive shaft. The cam member acts directly on a leaf spring for moving a hammer attached to the leaf spring generally in parallel relation to the axis of rotation of the cam member to thereby allow the hammer to strike against an associated gong.

3 Claims, 20 Drawing Figures

MOTOR ACTUATED BELL

BACKGROUND OF THE INVENTION

1. Field of the Invention

This invention relates to motor actuated bells of the type in which a motor drives a hammer means through a cam means to allow the same to strike against an associated gong to produce bell sound.

2. Prior Art

One conventional motor actuated bell, as shown in FIG. 20, comprises a small DC motor 100 having a drive shaft 101 on which a gear 102 is fixedly mounted, a wheel gear 103 fixedly mounted on a shft 104 and engaging the gear 102, and a cam 105 mounted on the shaft 104. With this construction, the motor 100 is driven to rotate the cam 105 through the meshed gears 102, 103 so that the cam intermittently acts on the end of a hammer 106 to allow the same to strike against an associated gong against the bias of a coil spring 107 to produce bell sound. This known motor driven bell has been found not entirely satisfactory in durability. This difficulty arises out of the fact that the axis of the shaft 104 which serves as the axis of rotation of the cam 105 is disposed perpendicular to the axis of the hammer 106 along which the hammer is moved. As a result, the shaft 104 is subjected to substantial lateral forces when the cam 105 strikes the hammer 106 so that associated bearing member (not shown) for the shaft 104 is also subjected to considerable forces. This gives rise to damage to the bearing members. Where the cam 105 is directly mounted on the motor drive shaft 101 for acting on the end of the hammer 106, the drive shaft 101 is also subjected to substantial lateral forces. This prevents the motor 100 from functioning properly for a prolonged period of time.

SUMMARY OF THE INVENTION

It is therefore an object of this invention to provide a motor actuated bell of the type which is capable of functioning properly for a prolonged period of time.

According to the invention, there is provided a motor actuated bell which comprises a base; a gong mounted on the base; a motor mounted on the base and having a drive shaft; a hammer means mounted on the base; and a cam member operatively connected to the motor drive shaft for rotation, the cam member acting on the hammer means for moving the hammer means generally in parallel relation to the axis of rotation of the cam member to thereby allow the hammer means to strike against the gong.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

BRIEF DESCRIPTION OF THE INVENTION

DESCRIPTION OF THE PREFERRED EMBODIMENTS OF THE INVENTION

Figure 1:
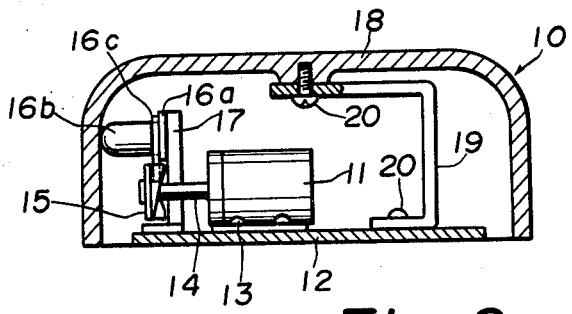
FIG. 1 is a cross-sectional view of a motor actuated bell provided in accordance with the present invention.
Figure 2:
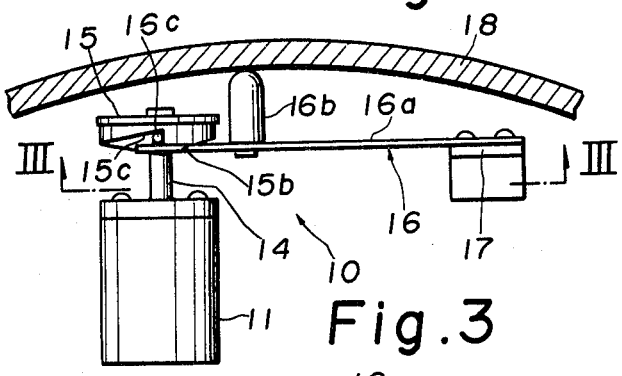
FIG. 2 is a schematic plan view of the bell.
Figure 3:
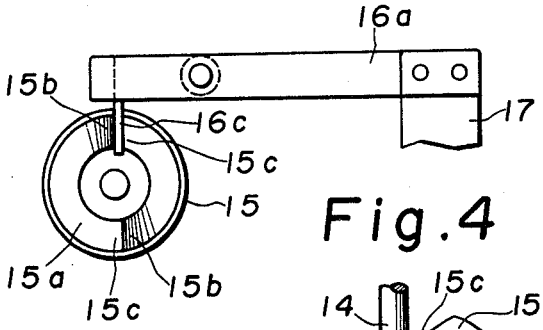
FIG. 3 is a cross-sectional view of the bell taken along the line III—III of FIG. 2.
Figure 4:
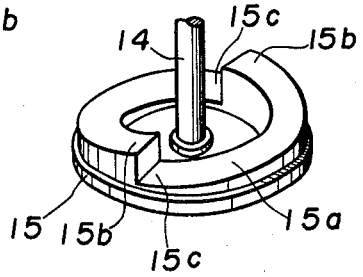
FIG. 4 is a perspective view of a cam member used in the bell.

FIGS. 1 and 2 show a motor actuated bell 10 in accordance with the present invention. An electric motor 11 is fixedly mounted on a mounting plate or base 12 by screws 13, the motor having a rotatable drive shaft 14 extending in parallel relation to the mounting plate 12. A circular cam member 15 is fixedly mounted at its center on the motor drive shaft 14 for rotation therewith about the axis thereof. The cam member 15 has a cam surface **15*a* at one side facing the motor 11, the cam surface having a pair of diametrically-opposed raised portions 15*b*, 15*b* and a pair of recessed portions 15*c*, 15*c* disposed respectively adjacent to the raised portions, as best shown in FIGS. 3 and 4**.

A hammer means 16 comprises a leaf spring **16*a* of a rectangular shape fixedly secured at one end to a post 17 extending from the mounting plate 12, and a hammer element 16*b* secured to the leaf spring 16*a* intermediate the opposite ends thereof, the leaf spring 16*a* extending in parallel relation to the mounting plate 12 and being disposed perpendicular to the motor drive shaft 14. The leaf spring 16*a* has a pin 16*c* secured thereto at its end remote from the post 17, the pin extending perpendicularly from the leaf spring 16*a* toward the mounting plate 12 and being held in sliding contact with the cam surface 15*a* as best shown in FIG. 2**.

As shown in FIG. 1, the mounting plate 12 is arranged within and connected to an inverted cup-shaped gong or bell 18 by a connecting member 19 of a generally channel-shaped cross-section, the connecting member 19 being secured to the mounting plate 12 and the gong 18 by screws 20.

In operation, the motor 11 is first driven through a power source (not shown) to rotate the cam member 15 in a clockwise direction (FIG. 3) so that each of the raised portions **15*b*, 15*b* of the cam surface 15*a* urges the leaf spring 16*a* away from the gong 18 through the pin 16*c* in sliding contact with the cam surface 15*a*, with the hammer element 16*b* retracted from the gong 18. Then, the pin 16*c* slides from the raised portion 15*b* into the adjacent recessed portion 15*c* whereupon the leaf spring 16*a* snaps back to allow the hammer element 16*b* to strike against the inner wall of the gong 18 to produce bell sound. Thus, the gong 18 is struck twice by the hammer element 16*b* during one revolution of the cam member 15. During the operation of the bell 10, the hammer element 16*b* is moved generally in parallel relation to the axis of rotation of the cam member 15**.

Figure 5:
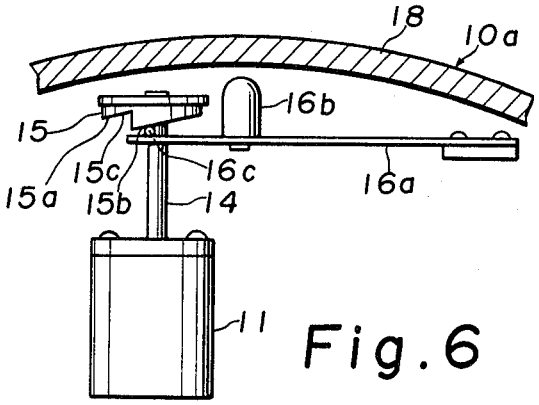
FIGS. 5 to 15 are views similar to FIG. 2, but showing modified bells, respectively.

FIG. 5 shows a modified bell **10*a* which differs from the bell 10 in that a cam surface 15*a* has only one raised portion 15*b*. With this construction, the gong 18 is struck once by the hammer element 16*b* during one revolution of the cam member 15**.

Figure 6:
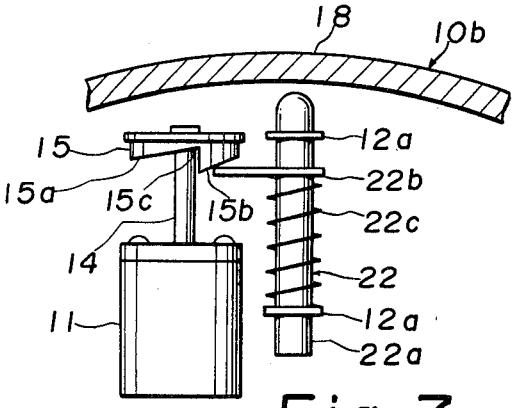

FIG. 6 shows another modified bell **10*b* which differs from the bell 10*a* shown in FIG. 5 only in that a modified hammer means 22 is provided. The hammer means 22 comprises a cylindrical hammer element 22*a* having a collar 22b fixedly mounted thereon, the hammer element 22a being disposed in parallel relation to the mounting plate 12 and the motor drive shaft 14. The hammer element 22a slidably extends through a pair of spaced stamped-out portions 12a, 12a of the mounting plate 12 for movement along its axis. A coil spring 22c is wound around the hammer elements 22a and acts between the collar 22b and the stamped-out portion 12a. The collar 22b is held in sliding contact with the cam surface 15a of the cam member 15 by the coil spring 22c**.

In operation, the motor 11 is driven to rotate the cam member 15 so that the raised portion 15b of the cam surface 15a urges the hammer element 22a away from the gong 18 against the bias of the coil spring 22c through the collar 22b in sliding contact with the cam surface 15a. Then, the collar 22b slides from the raised portion 15b into the adjoining recessed portion 15c whereupon the hammer element 22a is moved toward the gong 18 under the action of the coil spring 22c to strike against the inner wall of the gong 18 to produce bell sound. A plurality of raised portions 15b may be provided on the cam surface 15a.

Figure 7:
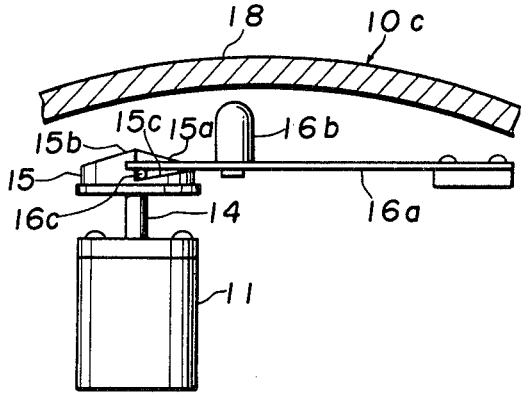

FIG. 7 shows a further modified bell 10c which differs from the bell 10 shown in FIGS. 1 and 2 in that the cam member 15 is mounted on the drive shaft 14 with the cam surface 15a facing away from the motor 11.

In operation, the motor 11 is driven to rotate the cam member 15 so that each of the raised portions 15b, 15b urges the leaf spring 16a toward the gong 18 through the pin 16c in sliding contact with the cam surface 15a to allow the hammer element 16b to strike against the gong to produce bell sound. Then, the pin 16c slides from the raised portion 15b into the adjoining recessed portion 15c whereupon the leaf spring 16a snaps back to move the hammer element 16b away from the gong 18. The gong 18 is struck twice by the hammer element 16b during one revolution of the cam member 15.

Figure 8:
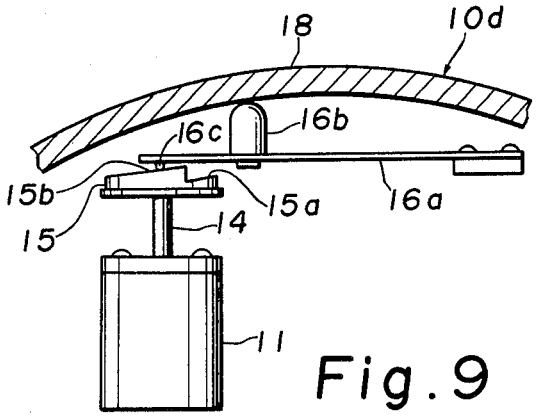

FIG. 8 shows a still further modified bell 10d which differs from the bell 10c shown in FIG. 7 in that a cam surface 15a has only one raised portion 15b. The gong 18 is struck once by the hammer element 16b during one revolution of the cam member 15.

Figure 9:
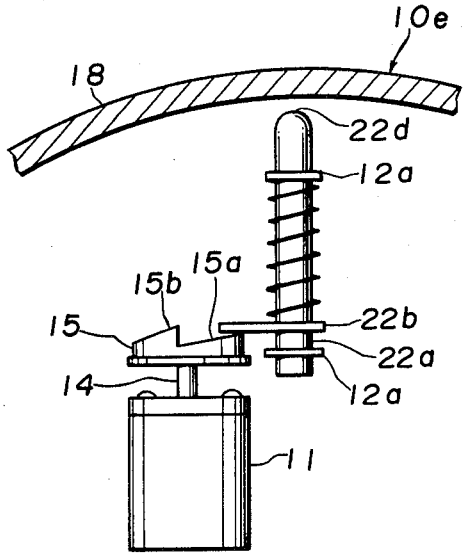

FIG. 9 shows a further modified bell 10e which differs from the bell 10b shown in FIG. 6 in that the cam member 15 is mounted on the drive shaft 14 with the cam surface 15a facing away from the motor 11. A collar 22b is fixedly mounted on the end portion of the hammer element 22a remote from the gong 18, and the hammer element 22a slidably extends through the stamped-out portions 12a, 12a of the mounting plate 12 for movement along its axis. The raised portion 15b urges the hammer element 22a into striking engagement with the gong 18 through the collar 22b in sliding contact with the cam surface 15a to thereby produce bell sound. A plurality of raised portions 15b, 15b may be provided on the cam surface 15a.

Figure 10:
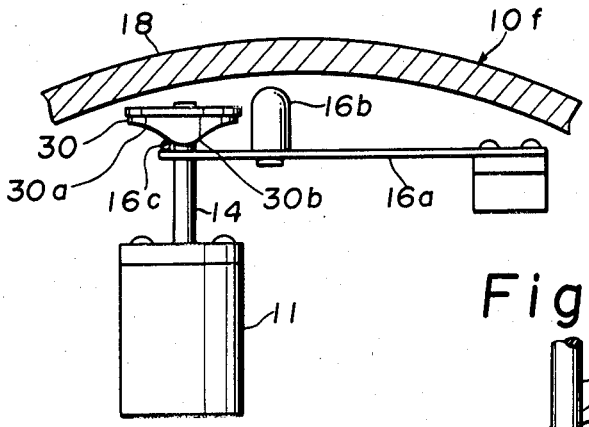
Figure 11:
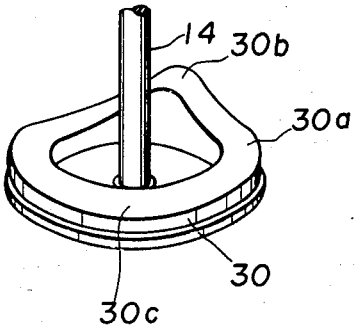

FIG. 10 shows a further modified bell 10f which differs from the bell 10 shown in FIGS. 1 and 2 in that a modified cam member 30 is provided. The cam member 30 of a circular shape is mounted at its center on the drive shape 14 for rotation therewith about the axis thereof. The cam member 30 has a cam surface 30a at one side facing the motor 11, the cam surface 30a being formed at the marginal portion of the cam member 30 and having a raised portion 30b of an arcuate contour and a flat portion 30c interrupted by the raised portion 30b, as best shown in FIG. 11. When the motor 11 is driven to rotate the cam member 30, the raised portion 30b urges the leaf spring 16a away from the gong 18 through the pin 16c in sliding contact with the cam surface 30a, with the hammer element 16b moved from the gong 18. Then, the pin 16c slides from the raised portion 30b into the flat portion 30c so that the hammer element 16b is urged into striking contact with the gong 18 under the action of the leaf spring 16a to thereby produce bell sound.

Figure 12:
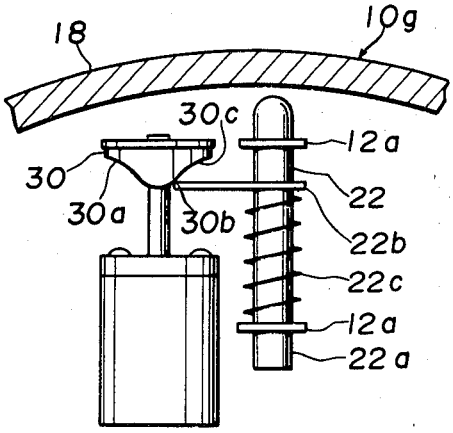

FIG. 12 shows a further modified bell 10g which differs from the bell 10f shown in FIG. 10 in that there is provided a modified hammer means 22 which is identical in construction to the hammer means 22 shown in FIG. 6. The raised portion 30b urges the hammer element 22a away from the gong 18 against the bias of the coil spring 22c through the collar 22b in sliding contact with the cam surface 30a. Then, the collar 22b slides from the raised portion 30b into the flat portion 30c so that the hammer element 22a is urged into striking contact with the gong 18 under the action of the coil spring 22c to thereby produce bell sound.

Figure 13:
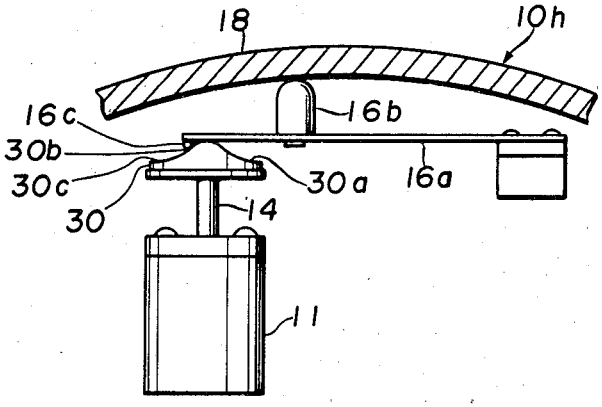

FIG. 13 shows a further modified bell 10h which differs from the bell 10f shown in FIG. 10 in that the cam member 30 is mounted on the drive shaft 14 with the cam surface 30a facing away from the motor 11. The raised portion 30b urges the leaf spring 16a toward the gong 18 through the pin 16c in sliding contact with the cam surface 30a to alllow the hammer element 16b to strike against the gong 18 to produce bell sound. Then, the pin 16c slides from the raised portion 30b into the flat portion 30c so that the hammer element 16b is moved away from the gong 18.

Figure 14:
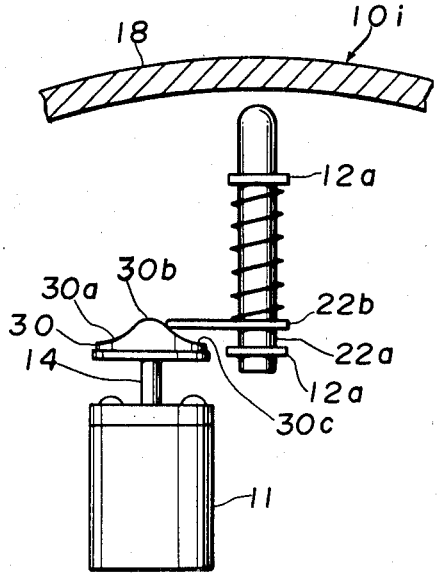

FIG. 14 shows a further modified bell 10i which differs from the bell 10g shown in FIG. 12 in that the cam member 30 is mounted on the drive shaft 14 with the cam surface 30a facing away from the motor 11. The collar 22b is fixedly mounted on the end portion of the hammer element 22a remote from the gong 18. The raised portion 30b urges the hammer element 22a into striking contact with the gong 18 through the collar 22b in sliding contact with the cam surface 30a to thereby produce bell sound.

A plurality of raised portions 30b may be provided on the cam surface 30a of the cam member 30 for the bells shown in FIGS. 10 to 14.

Figure 15:
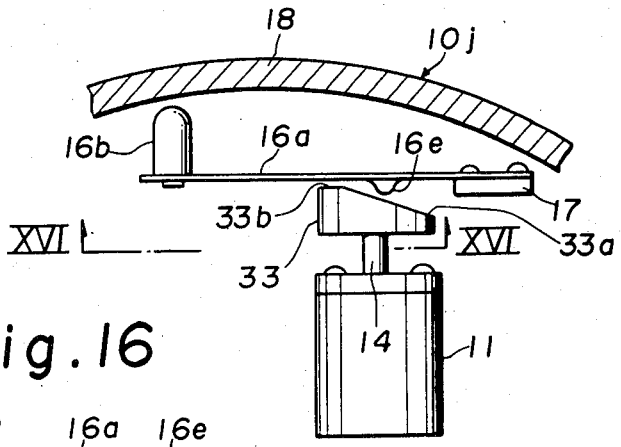
Figure 16:
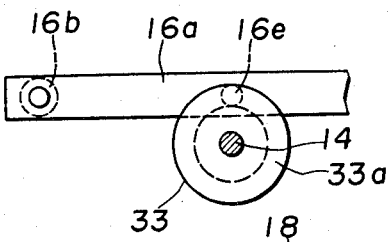
FIG. 16 is a cross-sectional view taken along the line XVI—XVI of FIG. 15.

FIG. 15 shows a further modified bell 10j which differs from the bell 10h shown in FIG. 13 in that a modified cam member 33 is provided. As best shown in FIG. 16, the cam member 33 of a circular shape is mounted on the drive shaft 14 at its center and has a cam surface 33a at one side facing away from the motor 11, the cam surface 33a being formed at the marginal portion of the cam member 33 and having a raised portion 33b. The leaf spring 16a has a projection 16e intermediate the hammer element 16b and the post 17, the projection 16e being engageable with the raised portion 33b. When the motor 11 is driven to rotate the cam member 33, the raised portion 33b is brought into engagement with the projection 16e to urge the leaf spring 16a toward the gong 18 so that the hammer element 16b is caused to strike against the gong 18 to produce bell sound. Then, the raised portion 33b becomes disengaged from the projection 16e to move the hammer element 16b away from the gong 18 under the action of the leaf spring 16a.

Figure 17:
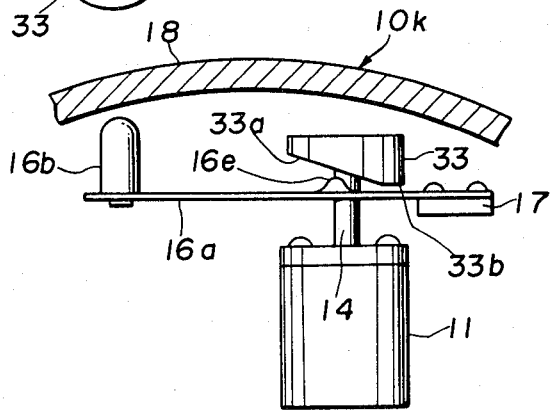
FIGS. 17 to 19 are views similar to FIG. 2 but showing further modified bells, respectively.

FIG. 17 shows a further modified bell 10k which differs from the bell 10j shown in FIG. 15 in that the cam member 33 is mounted on the drive shaft 14 with the cam surface 33a facing the motor 11. The raised portion 33b is brought into engagement with the projection 16e to urge the leaf spring 16a away from the gong 18, with the hammer element 16b moved away from the gong 18. Then, the raised portion 33b becomes disengaged from the projection 16e so that the hammer element 16b is caused to strike against the gong 18 under the action of the leaf spring 16a to produce bell sound.

A plurality of raised portions 33b may be formed on the cam surface 33a of the cam member 33 for the bells shown in FIGS. 15 and 17.

Figure 18:
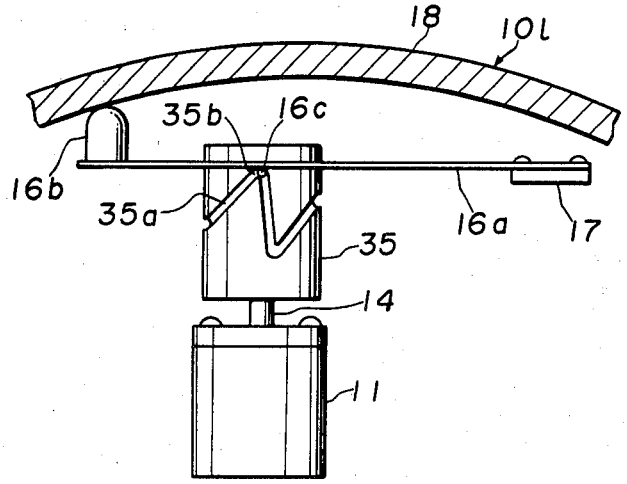

FIG. 18 shows a further modified bell 10l which differs from the bell 10 shown in FIGS. 1 and 2 in that a modified cam member 35 is provided. The cam member 35 comprises a cylindrical body mounted at its center on the drive shaft 14 for rotation therewith about its axis, the cam body having a zigzag slot 35a formed in the cylindrical surface. The zigzag slot 35a has a pair of diametrically opposed apexes 35b and is asymmetry with respect to the axis of the cylindrical cam member 35. The pin 16c is received in the slot 35a for movement therealong, the pin being secured to the leaf spring 16a intermediate the hammer element 16b and the post 17. The motor 11 is driven to rotate the cam member 35 so that the pin 16c slides along the slot 35a to impart a swinging movement to the hammer element 16b through the leaf spring 16a, the hammer element 16b being moved generally in parallel relation to the axis of rotation of the cam member 35. When the pin 16c slides into the apex 35b of the slot 35, the hammer element 16b strikes against the gong 18 to produce bell sound. It will be appreciated that the gong 18 is struck twice by the hammer element 16b during one revolution of the cam member 35.

Figure 19:
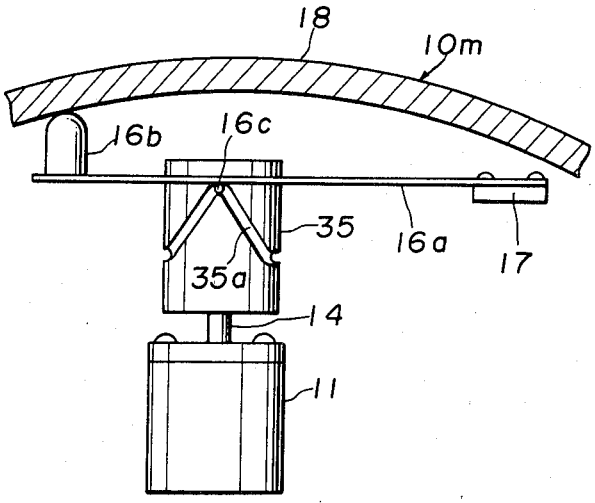
Figure 20:
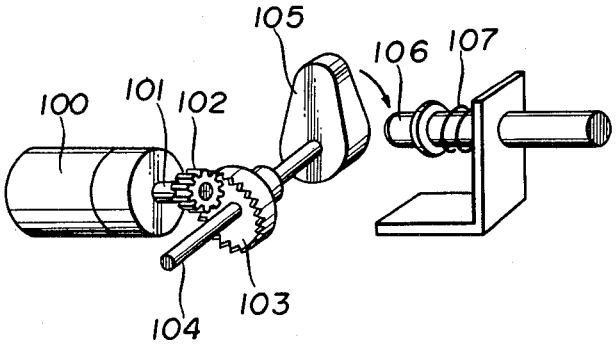
Fig. 20 (Prior Art)
FIG. 20 is a schematic perspective view of a motor actuated bell constructed in accordance with the prior art.

FIG. 19 shows a further modified bell 10m which differs from the bell 10l shown in FIG. 18 in that a modified cylindrical cam member 35 is provided. A zigzag slot 35a formed in the cylindrical surface of the cam member 35 is symmetrical with respect to the axis of the cam member 35.

With the construction of the above described motor actuated bells, the cam member acts on the hammer means through the pin 16c or the projection 16e in such a manner that the motor drive shaft, on which the cam member is mounted, axially supports the load applied by the hammer means. Therefore, the motor drive shaft is not substantially subjected to undue lateral forces and hence the motor is capable of functioning properly for a prolonged period of time.

A speed reducer may be connected between the motor drive shaft and the cam member to actuate the hammer means at a lower speed. In this case, a shaft supporting the cam member is arranged to axially supports the load applied by the hammer means. Therefore, associated bearing members for this support shaft is not subjected to undue forces.

While the motor actuated bells according to this invention have been specifically shown and described herein, the invention itself is not to be restricted by the exact showing of the drawings or the description thereof. For example, the pin 16c may be omitted to allow the cam surface to directly engage the leaf spring.

What is claimed is:

1. A motor actuated bell which comprises:

(a) a base;

(b) a gong mounted on said base;

(c) a motor mounted on said base within said gong and having a rotatable drive shaft extending in parallel relation to said base;

(d) a hammer means comprising (i) a hammer element for striking against the inner wall of said gong and (ii) a leaf spring fixedly secured at one end thereof to said base and extending in parallel spaced relation thereto, said leaf spring carrying said hammer element at the other end thereof; and (e) a circular cam member operatively and fixedly connected to said motor drive shaft for rotation therewith about the axis of said shaft, said cam member having a cam surface for acting directly on said leaf spring for moving said hammer element toward and away from the inner wall of said gong, and said leaf spring being disposed perpendicular to the axis of said cam member.

2. A bell according to claim 1, in which said leaf spring has a pin secured thereto and said cam surface acts on said pin in such a manner that said pin slides along the surface of said cam.

3. A motor actuated bell according to claim 1, wherein said leaf spring has a pin secured thereto, said cam member comprises a cylindrical member having a zigzag slot formed in the cylindrical surface thereof, and said pin is received in said slot for movement therealong.

* * * * *